US007633465B2

(12) United States Patent
Sakata et al.

(10) Patent No.: US 7,633,465 B2
(45) **Date of Patent: *Dec. 15, 2009**

(54) PLASMA DISPLAY APPARATUS AND DRIVING METHOD OF A PLASMA DISPLAY PANEL

(75) Inventors: Kazuaki Sakata, Yamanashi-ken (JP); Masaru Nishimura, Yamanashi-ken (JP); Atsushi Hirota, Yamanashi-ken (JP); Tsutomu Tokunaga, Yamanashi-ken (JP); Hai Lin, Yamanashi-ken (JP)

(73) Assignee: Panasonic Corporation, Osaka (JP)

( * ) Notice: Subject to any disclaimer, the term of this patent is extended or adjusted under 35 U.S.C. 154(b) by 691 days.

This patent is subject to a terminal disclaimer.

(21) Appl. No.: 11/110,957

(22) Filed: Apr. 21, 2005

(65) Prior Publication Data

US 2005/0248511 A1 Nov. 10, 2005

(30) Foreign Application Priority Data

May 6, 2004 (JP) ..... 2004-137528
Jul. 12, 2004 (JP) ..... 2004-204158
Nov. 24, 2004 (JP) ..... 2004-338259

(51) Int. Cl.
*G09G 3/28* (2006.01)

(52) U.S. Cl. ..... 345/60; 345/63; 345/66; 345/68; 345/69

(58) Field of Classification Search ..... 345/60–68, 345/209, 89, 690, 204, 205, 210, 691; 313/503, 313/486, 496, 582, 587, 485, 586, 505; 315/169.1–169.4; 349/122; 359/885; 442/16; 428/690
See application file for complete search history.

(56) References Cited

U.S. PATENT DOCUMENTS 4,791,336 A * 12/1988 Morimoto et al. ..... 313/496
6,175,194 B1 * 1/2001 Saegusa et al. ..... 315/169.4
6,417,824 B1 * 7/2002 Tokunaga et al. ..... 345/60
6,486,611 B2 * 11/2002 Tokunaga et al. ..... 315/169.4
6,515,811 B2 * 2/2003 Ikuhara et al. ..... 359/885
6,614,165 B1 * 9/2003 Aoki et al. ..... 313/485
6,614,413 B2 * 9/2003 Tokunaga et al. ..... 345/63
6,621,211 B1 * 9/2003 Srivastava et al. ..... 313/503
6,692,660 B2 * 2/2004 Kumar ..... 252/301.4 R (Continued)

FOREIGN PATENT DOCUMENTS

EP 1 298 694 A1 4/2003

(Continued)

OTHER PUBLICATIONS

"Cathodo-Luminescence of MgO" by B. D. Saksenaj and L. M. Pant; National Physical Laboratory of India, New Delhi, India; Department of Physics, University of Allahabad, Allahabad; Jun. 8, 1954.*

(Continued)

*Primary Examiner*—Prabodh M Dharia
(74) *Attorney, Agent, or Firm*—Sughrue Mion, PLLC

(57) ABSTRACT

A plasma display apparatus and a driving method of a plasma display panel which can improve a gradation expressing ability at low luminance. A magnesium oxide layer containing a magnesium oxide crystal which is excited by irradiation of an electron beam and performs a cathode luminescence light emission having a peak in a wavelength range of 200 to 300 nanometers is provided in each of display cells formed on the plasma display panel. When driving for a plurality of subfields having different luminance weights is performed, a sustaining discharge is caused only once in the subfield having the minimum luminance weight.

24 Claims, 14 Drawing Sheets

U.S. PATENT DOCUMENTS

| | | | | |
|---|---|---|---|---|
| 6,710,755 | B1 * | 3/2004 | Shiozaki et al. | 345/60 |
| 6,833,672 | B2 * | 12/2004 | Aoki et al. | 313/582 |
| 7,102,287 | B2 * | 9/2006 | Nishitani et al. | 313/587 |
| 7,176,856 | B2 * | 2/2007 | Yahagi et al. | 345/68 |
| 7,261,952 | B2 * | 8/2007 | Tak et al. | 428/690 |
| 7,333,076 | B2 * | 2/2008 | Nakamura et al. | 345/60 |
| 7,463,220 | B2 * | 12/2008 | Sakata et al. | 345/60 |
| 7,522,128 | B2 * | 4/2009 | Tokunaga et al. | 345/60 |
| 2001/0053034 | A1 * | 12/2001 | Ikuhara et al. | 359/885 |
| 2002/0008817 | A1 * | 1/2002 | Ito et al. | 349/122 |
| 2002/0054000 | A1 * | 5/2002 | Tokunaga et al. | 345/60 |
| 2003/0107318 | A1 * | 6/2003 | Aoki et al. | 313/582 |
| 2003/0132897 | A1 * | 7/2003 | Tokunaga | 345/60 |
| 2003/0137234 | A1 * | 7/2003 | Aoki et al. | 313/486 |
| 2003/0156080 | A1 * | 8/2003 | Koike et al. | 345/60 |
| 2003/0176124 | A1 * | 9/2003 | Koike et al. | 442/16 |
| 2004/0007961 | A1 * | 1/2004 | Srivastava et al. | 313/486 |
| 2004/0051689 | A1 * | 3/2004 | Nakamura et al. | 345/89 |
| 2004/0066394 | A1 * | 4/2004 | Tokunaga et al. | 345/690 |
| 2004/0075388 | A1 * | 4/2004 | Miyashita et al. | 313/586 |
| 2004/0137273 | A1 * | 7/2004 | Tak et al. | 428/690 |
| 2004/0179004 | A1 * | 9/2004 | Yahagi et al. | 345/209 |
| 2004/0263733 | A1 * | 12/2004 | Ito et al. | 349/122 |
| 2005/0248510 | A1 * | 11/2005 | Sakata et al. | 345/67 |
| 2005/0264487 | A1 * | 12/2005 | Tokunaga et al. | 345/63 |
| 2007/0008244 | A1 * | 1/2007 | Sakata | 345/63 |

FOREIGN PATENT DOCUMENTS

| | | | |
|---|---|---|---|
| EP | 1 335 342 | A2 | 8/2003 |
| EP | 1 381 016 | A2 | 1/2004 |
| JP | 07-192630 | | 7/1995 |
| JP | 2003-302929 | A | 10/2003 |

OTHER PUBLICATIONS

European Office Action dated Nov. 19, 2007 issued in European Application No. 05 103 134.2.

* cited by examiner

FIG. 9

| GRADATION | LIGHT – EMITTING PATTERN | | | | | | | | | | |
|---|---|---|---|---|---|---|---|---|---|---|---|
| | SF 1 | SF 2 | SF 3 | SF 4 | SF 5 | ..... | SF N-4 | SF N-3 | SF N-2 | SF N-1 | SF N |
| 1 | | | | | | | | | | | |
| 2 | ○ | | | | | | | | | | |
| 3 | | ○ | | | | | | | | | |
| 4 | ○ | ○ | | | | | | | | | |
| 5 | | | ○ | | | | | | | | |
| ⋮ | | ⋮ | | | | | | | | | |
| $2^N-5$ | | ○ | | ○ | ○ | | ○ | ○ | ○ | ○ | ○ |
| $2^N-4$ | ○ | ○ | | ○ | ○ | | ○ | ○ | ○ | ○ | ○ |
| $2^N-3$ | | | ○ | ○ | ○ | | ○ | ○ | ○ | ○ | ○ |
| $2^N-2$ | ○ | | ○ | ○ | ○ | ..... | ○ | ○ | ○ | ○ | ○ |
| $2^N-1$ | | ○ | ○ | ○ | ○ | | ○ | ○ | ○ | ○ | ○ |
| $2^N$ | ○ | ○ | ○ | ○ | ○ | | ○ | ○ | ○ | ○ | ○ |

○: SUSTAINING DISCHARGE LIGHT EMISSION

FIG. 14

| GRADATION | LIGHT – EMITTING PATTERN | | | | | | | | | | |
|---|---|---|---|---|---|---|---|---|---|---|---|
| | SF 1 | SF 2 | SF 3 | SF 4 | SF 5 | ..... | SF N-4 | SF N-3 | SF N-2 | SF N-1 | SF N |
| 1 | | | | | | | | | | | |
| 2 | ○ | | | | | | | | | | |
| 3 | ○ | ○ | | | | | | | | | |
| 4 | ○ | ○ | ○ | | | | | | | | |
| 5 | ○ | ○ | ○ | ○ | | | | | | | |
| ⋮ | | ⋮ | | | | | | | | | |
| N−3 | ○ | ○ | ○ | ○ | ○ | | ○ | | | | |
| N−2 | ○ | ○ | ○ | ○ | ○ | | ○ | ○ | | | |
| N−1 | ○ | ○ | ○ | ○ | ○ | ..... | ○ | ○ | ○ | | |
| N | ○ | ○ | ○ | ○ | ○ | | ○ | ○ | ○ | ○ | |
| N+1 | ○ | ○ | ○ | ○ | ○ | | ○ | ○ | ○ | ○ | ○ |

○: SUSTAINING DISCHARGE LIGHT EMISSION

PLASMA DISPLAY APPARATUS AND DRIVING METHOD OF A PLASMA DISPLAY PANEL

BACKGROUND OF THE INVENTION

1. Field of the Invention

The invention relates to a plasma display apparatus for displaying an image and a driving method of a plasma display panel.

2. Description of the Related Art

As a thin image display apparatus, a plasma display apparatus with an AC type (alternating current discharge type) plasma display panel has been put into practical use (for example, refer to FIG. 1 of Japanese Patent Kokai No. 2003-302929 (hereinafter referred to as Patent Document 1)). The plasma display panel mounted in the plasma display apparatus comprises: a front substrate on which a plurality of scanning electrodes and sustaining electrodes serving as display lines of a display screen have been formed; and a rear substrate on which a plurality of data electrodes have been formed. The front substrate and the rear substrate are arranged in parallel. A discharge space in which discharge gases consisting of neon, xenon, and the like have been sealed is formed between the substrates. In the discharge space, the data electrodes and both of the scanning electrodes and the sustaining electrodes are arranged so as to cross each other and a discharge cell serving as a pixel is formed at each crossing portion.

To obtain halftone display luminance corresponding to an input video signal, gradation driving using a subfield method is executed to the plasma display panel (for example, refer to FIG. 2 of the Patent Document 1). In the gradation driving, one field is constituted by an initializing period and subsequent eight subfields SF1 to SF8. Each subfield is constituted by a writing period, a sustaining period, and an erasure initializing period. In the writing period in each subfield, a data pulse is selectively applied to each data electrode while a scanning pulse is sequentially applied to each scanning electrode. In this process, a discharge is caused in the discharge cell in the crossing portion of the scanning electrode to which the scanning pulse is applied and the data electrode to which the data pulse is applied. Each discharge cell is set to either a light-emission possible state or a light emission impossible state. In the sustaining period, by applying sustaining pulses to the scanning electrode and the sustaining electrode by the number of times corresponding to a luminance weight of each subfield, only the discharge cells which have been set into the light-emission possible state are allowed to repeatedly perform a sustaining discharge. For example, in the sustaining period of the subfield SF1 having the minimum luminance weight, one sustaining pulse is applied to each of the scanning electrode and the sustaining electrode. In this instance, the sustaining discharge is caused twice between the scanning electrode and the sustaining electrode each time the sustaining pulse is applied. In the subfield SF2 whose luminance weight is larger than that of the subfield SF1 by one stage, since the four sustaining pulses are applied to each of the scanning electrode and the sustaining electrode in the sustaining period, the sustaining discharge is caused eight times.

According to the driving process described above, halftone luminance can be expressed correspondingly to the total number of times of the sustaining discharge caused in the subfields SF1 to SF8. For example, if the sustaining discharge is not caused in all of the subfields SF1 to SF8, a luminance level "0", that is, the lowest luminance level can be expressed. In the case of expression of an image whose luminance is higher than the lowest luminance level by one step, the sustaining discharge is caused only in the SF1 among the subfields SF1 to SF8. That is, in this case, a luminance level "2" corresponding to the number of times "2" of the sustaining discharge by the subfield SF1 is expressed.

According to the driving method described above, however, since a large luminance difference of "2" exists between the lowest luminance level "0" and the luminance level "2" whose luminance is higher than that by one step, the method has a problem that a luminance change in the image of low luminance cannot be smoothly expressed.

SUMMARY OF THE INVENTION

The invention has been made to solve the problem and it is an object of the invention to provide a plasma display apparatus and a driving method of a plasma display panel, in which a gradation expressing ability at low luminance can be improved.

According to the first aspect of the invention, there is provided a plasma display apparatus in which a plasma display panel on which a display cell having a discharge space is formed in each of crossing portions of a plurality of row electrode pairs and a plurality of column electrodes extending in the direction which crosses each of the row electrode pairs is driven for each of a plurality of subfields having different luminance weights, comprising: a magnesium oxide layer containing a magnesium oxide crystal which is formed in each of the display cells, is excited by irradiation of an electron beam, and performs a cathode luminescence light emission having a peak in a wavelength range of 200 to 300 nm (nanometers); an addressing component for setting each of the display cells into a light-on cell state or a light-off cell state by selectively causing a selective discharge in the discharge space of each of the display cells by sequentially applying a scanning pulse to one row electrode of each of the row electrode pairs and applying a data pulse corresponding to an input video signal to each of the column electrodes; and a sustaining component for causing a sustaining discharge in the display cell which has been set into the light-on cell state by applying sustaining pulses to each of the row electrode pairs by the number of times corresponding to the luminance weight of each of the subfields, wherein the sustaining component applies the sustaining pulse to the row electrode pair only once in the subfield having the minimum luminance weight among the subfields.

According to another aspect of the invention, there is provided a driving method of a plasma display panel which is driven every plural subfields having different luminance weights and on which a display cell having a magnesium oxide layer containing a magnesium oxide crystal that is excited by irradiation of an electron beam and performs a cathode luminescence light emission having a peak in a wavelength range of 200 to 300 nm and a discharge space which faces the magnesium oxide layer is formed in each of crossing portions of a plurality of row electrode pairs and a plurality of column electrodes extending in the direction which crosses each of the row electrode pairs, comprising: an addressing step of setting each of the display cells into a light-on cell state or a light-off cell state by selectively causing a selective discharge in the discharge space of each of the display cells by sequentially applying a scanning pulse to one row electrode of each of the row electrode pairs and applying a data pulse corresponding to an input video signal to each of the column electrodes; and a sustaining step of causing a sustaining discharge in the discharge space of the display cell which has been set into the light-on cell state by applying a sustaining pulse to each of the row electrode pairs, wherein in the sustaining step, the sustaining pulse is applied to the row electrode pair only once in the subfield having the minimum luminance weight among the subfields.

When the plasma display panel having a plurality of display cells in each of which the magnesium oxide layer containing magnesium oxide monocrystalline powder with a cubic polycrystalline structure has been formed is driven every plural subfields having different luminance weights, the sustaining discharge is caused only once in the subfield of the minimum luminance weight.

BRIEF DESCRIPTION OF THE DRAWINGS

FIG. 6 is a diagram schematically showing the state where a vapor phase magnesium oxide monocrystal 13B has been adhered onto the surface of a dielectric layer 12 by a spray method, an electrostatic coating method, or the like;

FIG. 9 is a diagram showing light-emitting patterns when the $2^N$ gradation driving is executed in N subfields;

FIG. 14 is a diagram showing light-emitting patterns when the (N+1) gradation driving is executed in the N subfields;

DETAILED DESCRIPTION OF THE PREFERRED EMBODIMENT

Figure 1:
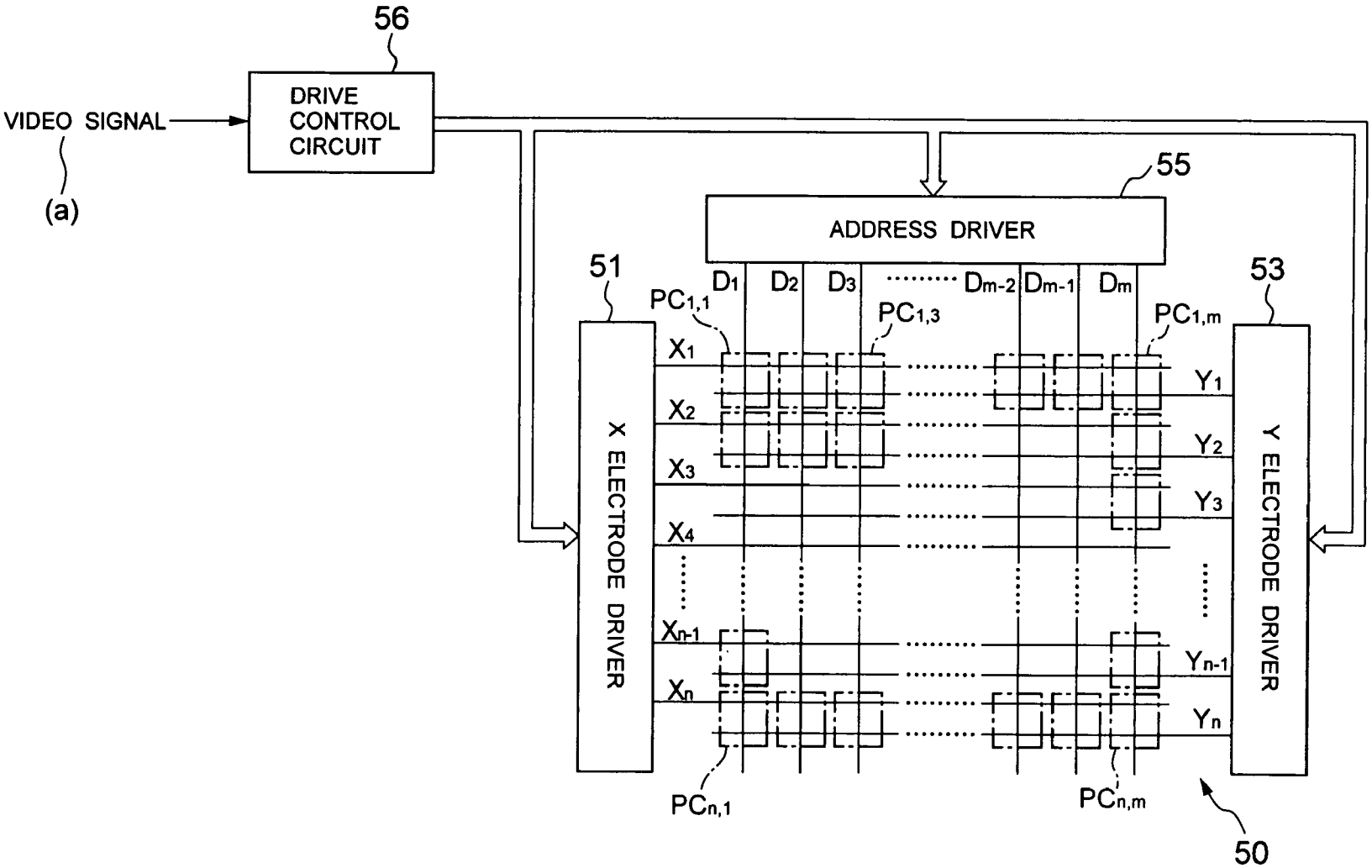
FIG. 1 is a diagram showing a schematic construction of a plasma display apparatus according to the invention.

FIG. 1 is a diagram showing a schematic construction of a plasma display apparatus according to the invention.

As shown in FIG. 1, the plasma display apparatus is constructed by: a PDP 50 as a plasma display panel; an X electrode driver 51; a Y electrode driver 53; an address driver 55; and a drive control circuit 56.

Column electrodes $D_1$ to $D_m$ arranged so as to extend in the longitudinal direction (vertical direction) of a 2-dimensional display screen, respectively; and row electrodes $X_1$ to $X_n$ and row electrodes $Y_1$ to $Y_b$ arranged so as to extend in the lateral direction (horizontal direction), respectively, are formed in the PDP 50. At this time, the row electrode pairs $(Y_1, X_1)$, $(Y_2, X_2)$, $(Y_3, X_3)$, . . . , and $(Y_n, X_n)$ each of which is constructed by the adjacent row electrodes function as first to nth display lines in the PDP 50. A display cell PC serving as a pixel is formed in each crossing portion (area surrounded by an alternate long and short dash line in FIG. 1) of each display line and each of the column electrodes $D_1$ to $D_m$. That is, display cell $PC_{1,1}$ to $PC_{1,m}$ belonging to the first display line, display cell $PC_{2,1}$ to $PC_{2,m}$ belonging to the second display line, . . . , and display cell $PC_{n,1}$ to $PC_{n,m}$ belonging to the nth display line are arranged in the PDP 50 in a matrix shape.

Figure 2:
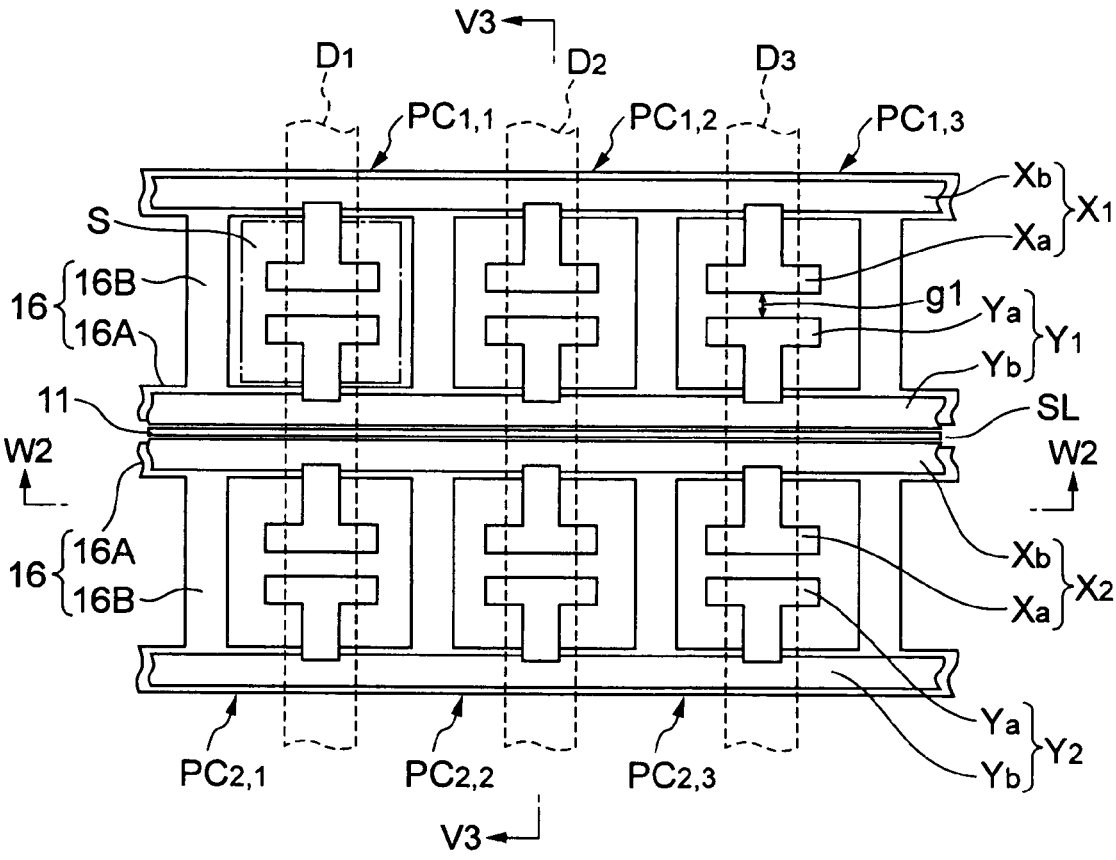
FIG. 2 is a front view schematically showing an internal structure of a PDP 50 seen from the display screen side.
Figure 3:
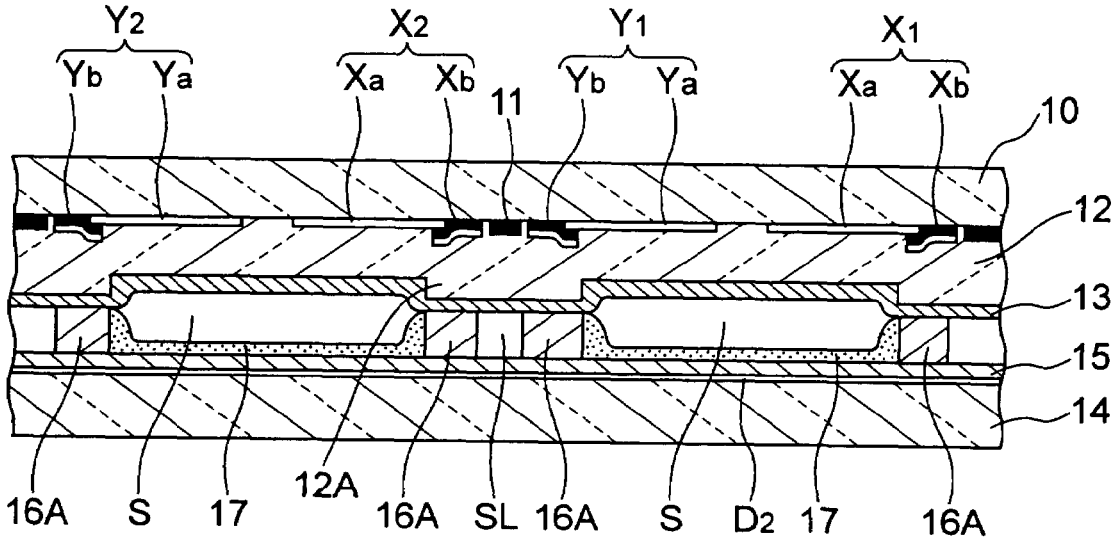
FIG. 3 is a diagram showing a cross section taken along the line V3-V3 shown in FIG. 2.

FIG. 2 is a front view schematically showing an internal structure of the PDP 50 seen from the display screen side. In FIG. 2, each crossing portion of each of the column electrodes $D_1$ to $D_3$ of the PDP 50, the first display line $(Y_1, X_1)$, and the second display line $(Y_2, X_2)$ is extracted and shown. FIG. 3 is a diagram showing a cross section of the PDP 50 taken along the line V3-V3 in FIG. 2. FIG. 3 is a diagram showing a cross section of the PDP 50 taken along the line "W2-W2 in FIG. 2.

Figure 5A:
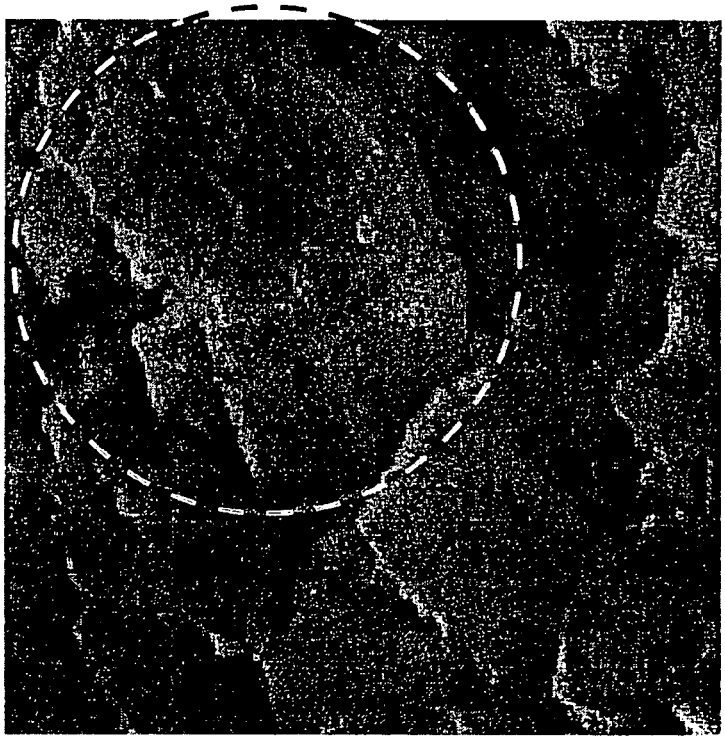
FIGS. 5A and 5B are diagrams showing an example of a magnesium oxide monocrystal.

As shown in FIG. 2, each row electrode X is constructed by: a bus electrode Xb extending in the horizontal direction of a 2-dimensional display screen; and a T-shaped transparent electrode Xa provided in a position on the bus electrode Xb corresponding to each display cell PC so as to be in contact with the bus electrode Xb. Each row electrode Y is constructed by: a bus electrode Yb extending in the horizontal direction of the 2-dimensional display screen; and a T-shaped transparent electrode Ya provided in a position on the bus electrode Yb corresponding to each display cell PC so as to be in contact with the bus electrode Yb. Each of the transparent electrodes Xa and Ya is made of a transparent conductive film of, for example, ITO or the like. Each of the bus electrodes Xb and Yb is made of, for example, a metal film. As shown in FIG. 3, the row electrode X comprising the transparent electrode Xa and the bus electrode Xb and the row electrode Y comprising the transparent electrode Ya and the bus electrode Yb are formed on the rear side of a front transparent substrate 10 whose front side functions as a display surface of the PDP 50. In this instance, the transparent electrodes Xa and Ya in each row electrode pair (X, Y) are extended toward the row electrode side of the partner which mutually forms the pair and the top sides of their wide width portions face each other through a discharge gap g1 of a predetermined width. On the rear side of the front transparent substrate 10, a light absorbing layer (light shielding layer) 11 of a black or dark color which is extended in the horizontal direction of the 2-dimensional display screen is formed between one row electrode pair $(X_1, Y_1)$ and the row electrode pair $(X_2, Y_2)$ adjacent thereto. A dielectric layer 12 is formed on the rear side of the front transparent substrate 10 so as to cover the row electrode pair (X, Y). As shown in FIG. 3, on the rear side (surface opposite to the surface with which the row electrode pair is come into contact) of the dielectric layer 12, a raising dielectric layer 12A is formed in the portion corresponding to the area where the light absorbing layer 11 and the bus electrodes Xb and Yb adjacent thereto are formed. A magnesium oxide layer 13 containing a magnesium oxide crystal that is excited by irradiation of an electron beam and performs a cathode luminescence light emission having a peak in a wavelength range of 200 to 300 nm is formed on the surfaces of the dielectric layer 12 and the raising dielectric layer 12A. The magnesium oxide crystal contains a vapor phase magnesium oxide crystal which is obtained by vapor phase oxidizing magnesium vapor that is generated by heating magnesium. The vapor phase magnesium oxide crystal has, for example, a polycrystalline structure in which cubic crystals as shown in an SEM photograph image of FIG. 5A are fitted into one another or a cubic monocrystalline structure as shown in an SEM photograph image of FIG. 5B. An average grain diameter of the vapor phase magnesium oxide crystal is equal to 500 Å or more, preferably, 2000 Å or more (measurement result by the BET method).

Figure 6:
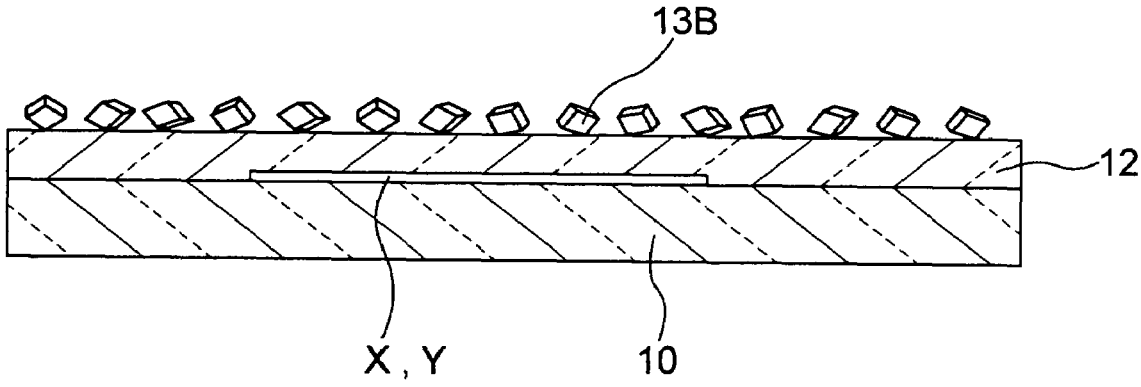

As shown in FIG. 6, the magnesium oxide layer 13 is formed by adhering the vapor phase magnesium oxide monocrystal 13B onto the surface of the dielectric layer 12 by the spray method, electrostatic coating method, or the like. It is also possible to form a thin film magnesium oxide layer onto the surface of the dielectric layer 12 by an evaporation deposition or a sputtering method, adhere the vapor phase magnesium oxide monocrystal onto the thin film magnesium oxide layer, and form the magnesium oxide layer 13.

Figure 4:
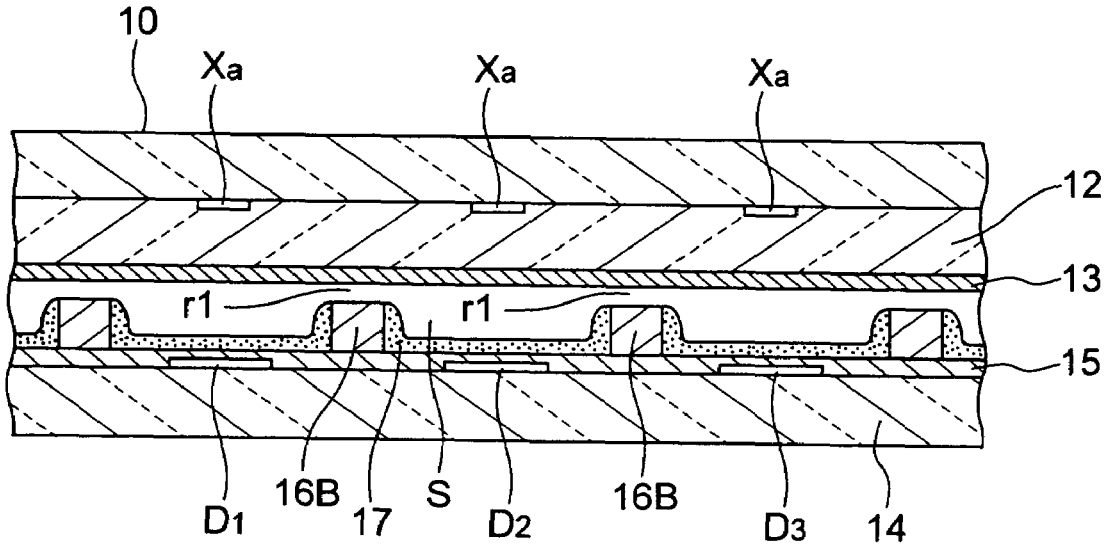
FIG. 4 is a diagram showing a cross section taken along the line W2-W2 shown in FIG. 2.

Each of the column electrodes D is formed on a rear substrate 14 arranged in parallel with the front transparent substrate 10 so as to be extended in the direction which perpendicularly crosses the row electrode pair (X, Y) in the position where each of the column electrodes D faces the transparent electrodes Xa and Ya in each of the row electrode pair (X, Y). A white column electrode protecting layer 15 which covers the column electrode D is further formed on the rear substrate 14. A partition 16 is formed on the column electrode protecting layer 15. The partition 16 is formed in a ladder shape by: a lateral wall 16A extending in the lateral direction of the 2-dimensional display screen in each position corresponding to the bus electrodes Xb and Yb of each row electrode pair (X, Y); and a vertical wall 16B extending in the vertical direction of the 2-dimensional display screen in each intermediate position between the adjacent column electrodes D. The partitions 16 in the ladder shape as shown in FIG. 2 are formed every display line of the PDP 50. A gap SL as shown in FIG. 2 exists between the adjacent partitions 16. The display cell PC including an independent discharge space S and the transparent electrodes Xa and Ya are partitioned by the ladder-shaped partitions 16. Discharge gases containing a xenon gas are sealed in the discharge space S. As shown in FIG. 3, phosphor layers 17 are formed on the side surface of the lateral wall 16A in each display cell PC, the side surface of the vertical wall 16B, and the surface of the column electrode protecting layer 15 so as to cover all of those surfaces. Actually, the phosphor layer 17 is made of three kinds of phosphor materials: phosphor for emitting red light; phosphor for emitting green light; and phosphor for emitting blue light. An interval between the discharge space S of each display cell PC and the gap SL is closed because the magnesium oxide layer 13 is come into contact with the lateral wall 16A as shown in FIG. 3. Since the vertical wall 16B is not come into contact with the magnesium oxide layer 13 as shown in FIG. 4, a gap r1 exists between them. That is, the discharge spaces S of the display cells PC which are adjacent to each other in the lateral direction of the 2-dimensional display screen are mutually communicated through the gap r1.

Figure 7:
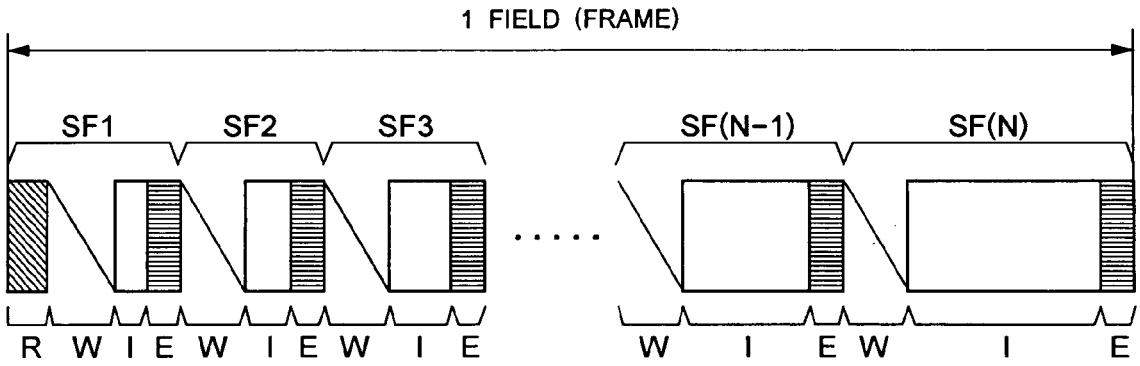
FIG. 7 is a diagram showing an example of a light emission driving sequence which is used in the plasma display apparatus shown in FIG. 1.

The drive control circuit 56 supplies various control signals to drive the PDP 50 having the structure in accordance with the light emission driving sequence using a subfield method as shown in FIG. 7 to each of the X electrode driver 51, the Y electrode driver 53, and the address driver 55.

In the light emission driving sequence shown in FIG. 7, N subfields SF1 to SF(N) each including an addressing step W, a sustaining step I, and an erasing step E are executed in a display period of each field (frame) in the input video signal, that is, in a unit display period which is spent to display an image of one display screen. Only the head subfield SF1 includes a resetting step R. The subfields SF1 to SF(N) are arranged in order of a smaller luminance weight in each field. That is, the luminance weight of the head subfield SF1 is the minimum and that of the last subfield SF(N) is the maximum. The X electrode driver 51, the Y electrode driver 53, and the address driver 55 form various driving pulses (which will be explained hereinafter) to drive the PDP 50 in accordance with the light emission driving sequence and supply them to the PDP 50.

Figure 8:
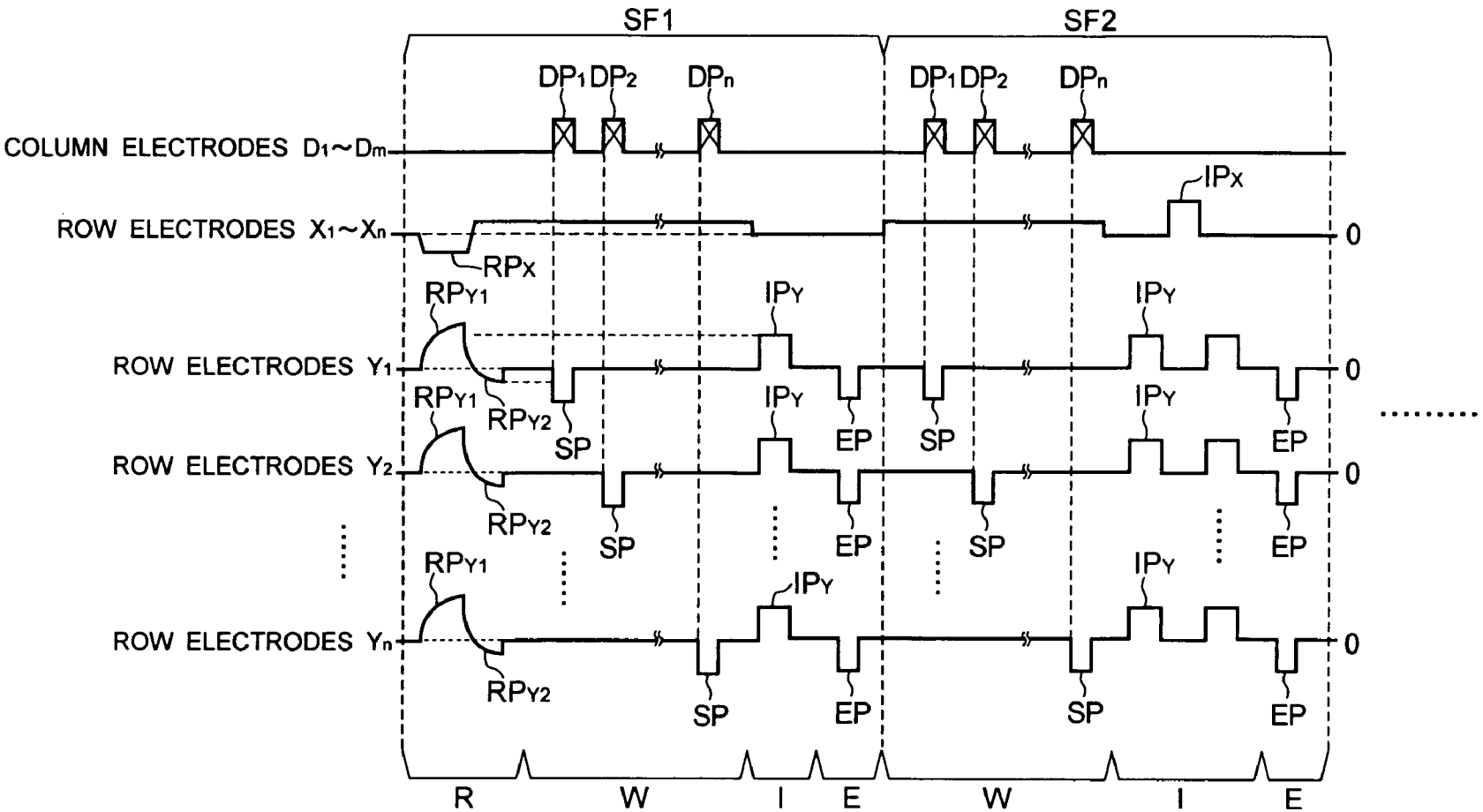
FIG. 8 is a diagram showing various driving pulses which are applied to the PDP 50 in accordance with the light emission driving sequence shown in FIG. 7 and their applying timing.

FIG. 8 is a diagram showing applying timing of the various driving pulses which are applied to the column electrodes D and the row electrodes X and Y of the PDP 50 with respect to SF1 and SF2 extracted from the subfields SF1 to SF(N).

First, in the resetting step R which is executed only in the head subfield SF1, the X electrode driver 51 applies a reset pulse $RP_X$ of a negative polarity to the row electrodes $X_1$ to $X_n$ in a lump as shown in FIG. 8. Further, simultaneously with the supply of the reset pulse $RP_X$, the Y electrode driver 53 applies a first reset pulse $RP_{Y1}$ of a positive polarity having a pulse waveform whose voltage value rises gently with the elapse of time and reaches a peak voltage value to the row electrodes $Y_1$ to $Y_n$ in a lump as shown in FIG. 8. The peak voltage value of the first reset pulse $RP_{Y1}$ is larger than that of each of sustaining pulses $IP_X$ and $IP_Y$. By simultaneously applying the first reset pulse $RP_{Y1}$ and the reset pulse $RP_X$ of the negative polarity, a first resetting discharge is caused between the row electrodes X and Y in each of all of the display cells $PC_{1,1}$ to $PC_{n,m}$. After the termination of the first resetting discharge, wall charges of a predetermined amount are formed on the surface of the magnesium oxide layer 13 in the discharge space S of each display cell PC. That is, the apparatus enters the state where the charges of the positive polarity are formed near the row electrode X on the surface of the magnesium oxide layer 13 and the charges of the negative polarity are formed near the row electrode Y, in other words, the state where what are called wall charges have been formed. After that, the Y electrode driver 53 forms a second reset pulse $RP_{Y2}$ of a negative polarity whose voltage change upon leading is gentle and applies it to all of the row electrodes $Y_1$ to $Y_n$ in a lump as shown in FIG. 8. A peak voltage value of the second reset pulse $RP_{Y2}$ is set to a value within a voltage range from the voltage value on the row electrode Y when no scanning pulses SP are applied in the addressing step W to the peak voltage value of the scanning pulses SP. In accordance with the supply of the second reset pulse $RP_{Y2}$, a second resetting discharge is caused between the row electrodes X and Y in each of all of the display cells $PC_{1,1}$ to $PC_{n,m}$. By the second resetting discharge, the wall charges formed in each of all of the display cells $PC_{1,1}$ to $PC_{n,m}$ are extinguished. That is, by the resetting step R, all of the display cells $PC_{1,1}$ to $PC_{n,m}$ are initialized to a light-off cell state where the wall charges of the predetermined amount do not exist. At the time of the first and second resetting discharges which are executed before an addressing discharge, since a discharge is caused in each display cell PC and the magnesium oxide layer 13 has been formed in the display cell PC, a priming effect by the resetting discharge is continued for a long time and a high addressing speed can be accomplished. In the resetting step R, by applying the first reset pulse $RP_{Y1}$ whose voltage change upon leading is gentle to the row electrode Y, a weak first resetting discharge is caused between the T-shaped transparent electrodes Ya and Xa, thereby improving contrast.

Subsequently, in the addressing step W of each subfield, the address driver 55 forms a pixel data pulse to set whether or not each display cell PC is allowed to execute the light emission in the subfield on the basis of the input video signal. For example, in the case of allowing the display cell PC to perform the light emission, the address driver 55 forms the pixel data pulse of a high voltage every display cell PC. When it is not allowed to perform the light emission, the address driver 55 forms the pixel data pulse of a low voltage every display cell PC. As shown in FIG. 8, the address driver 55 sequentially applies the pixel data pulses of one display line (m pulses) to the column electrodes $D_1$ to $D_m$ as pixel data pulse groups $DP_1, DP_2, \ldots$, and $DP_n$. For the period of time, the Y electrode driver 53 sequentially applies the scanning pulse SP of the negative polarity to the row electrodes $Y_1$ to $Y_n$ synchronously with the timing of each of the pixel data pulse groups $DP_1$ to $DP_n$. At this time, a discharge (selective discharge) is caused only in the display cell PC to which the scanning pulse SP has been applied and the pixel data pulse of the high voltage has been applied and wall charges of a predetermined amount are formed on the surface of each of the magnesium oxide layer 13 and the phosphor layer 17 in the discharge space S of the display cell PC. Since the selective discharge as mentioned above is not caused in the display cell PC to which the pixel data pulse of the low voltage has been applied although the scanning pulse SP has been applied, the forming state of the wall charges just before it is maintained.

That is, by the execution of the addressing step W, each display cell PC is set into either the light-on cell state where the wall charges of the predetermined amount exist or the light-off cell state where no wall charges exist on the basis of the input video signal.

Subsequently, in the sustaining step I of each subfield, each of the X electrode driver 51 and the Y electrode driver 53 applies the sustaining pulses $IP_X$ and $IP_Y$ of the positive polarity to the row electrodes $X_1$ to $X_n$ and $Y_1$ to $Y_n$ the number of times (period) corresponding to the luminance weight of the subfield. In the sustaining step I of the subfield SF1 of the minimum luminance weight, as shown in FIG. 8, the X electrode driver 51 does not apply the sustaining pulse $IP_X$ but the Y electrode driver 53 merely applies the sustaining pulse $IP_Y$ to the row electrodes $Y_1$ to $Y_n$ once. In the sustaining step I of each of the subfields SF1 to SF(N), each time the sustaining pulse $IP_X$ or $IP_Y$ is applied, a sustaining discharge is caused only in the display cell PC in the light-on cell state as mentioned above. In association with the sustaining discharge, the phosphor layer 17 emits the light and an image is formed on the panel screen.

In the erasing step E of each subfield, the Y electrode driver 53 applies an erasing pulse EP of a negative polarity to the row electrodes $Y_1$ to $Y_n$ as shown in FIG. 8. In accordance with the supply of the erasing pulse EP, an erasing discharge is caused in the display cell PC in which the sustaining discharge has been caused in the sustaining step I just before the discharge. By the erasing discharge, the wall charges formed in the display cell PC are extinguished and the display cell is shifted to the light-off cell state.

FIG. 9 is a diagram showing an example of light emission driving patterns which are formed by the driving shown in FIGS. 7 and 8.

That is, one of the first to $2^N$-th gradation driving as shown in FIG. 9 is executed in accordance with the luminance level expressed by the input video signal. In FIG. 9, a white circle denotes the state where the display cell PC is set into the light-on cell state in the addressing step W of the subfield and the sustaining discharge is caused in the sustaining step I. In this instance, the luminance corresponding to the total number of times of the sustaining discharge caused in the subfields SF1 to SF(N) is observed. That is, according to the $2^N$ kinds of light-emitting patterns by the first to $2^N$-th gradation driving as shown in FIG. 9, the luminance level shown by the input video signal can be expressed by the $2^N$ gradation.

In the case of performing a black display corresponding to the lowest luminance level, the first gradation driving as shown in FIG. 9 is executed. That is, in this instance, since the display cell PC is set into the light-off cell state in the addressing step W of each of the subfields SF1 to SF(N), no sustaining discharge is caused in the subfields SF1 to SF(N). Since the light emission of the display cell PC, therefore, is not executed, the black display corresponding to the luminance level 0 is observed.

According to the second gradation driving for realizing the display of the luminance that is higher than that in the first gradation driving by one stage, as shown in the white circle in FIG. 9, the display cell PC performs the sustaining discharge only in SF1 among the subfields SF1 to SF(N). In this instance, in the sustaining step I of the subfield SF1, since only the sustaining pulse $IP_Y$ is applied to the row electrode Y only once as shown in FIG. 8, the image of the luminance level "1" corresponding to one sustaining discharge according to the sustaining pulse $IP_Y$ is observed.

As mentioned above, in the sustaining step I of the subfield SF1, since the sustaining discharge is caused only once, an amount of priming particles in the discharge space of the display cell PC is insufficient. That is, a discharge lag occurs in the selective discharge in the addressing step W of the next subfield SF2 and there is a possibility that the stability of the selective discharge is deteriorated.

Figure 5B:
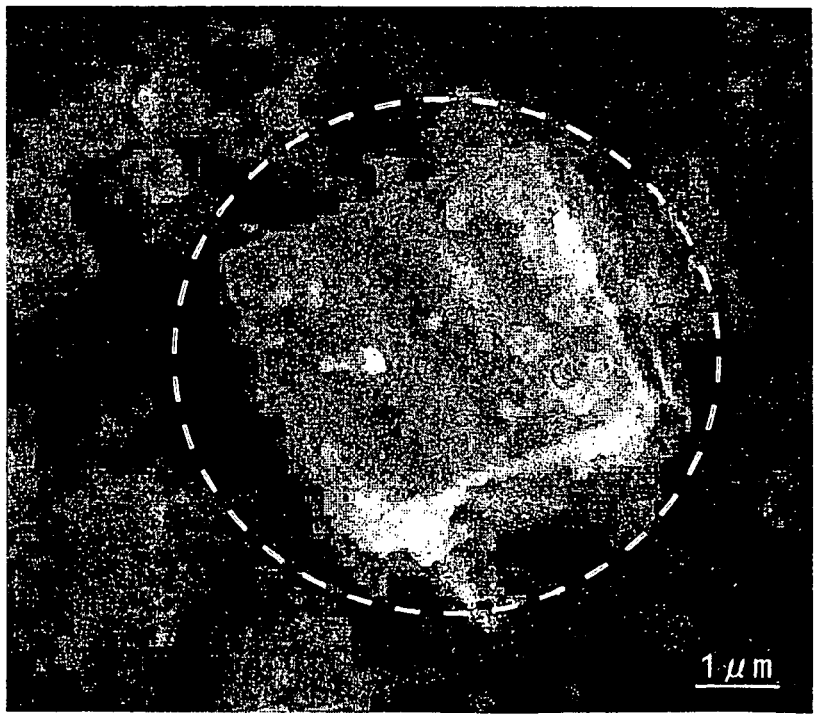
Figure 10:
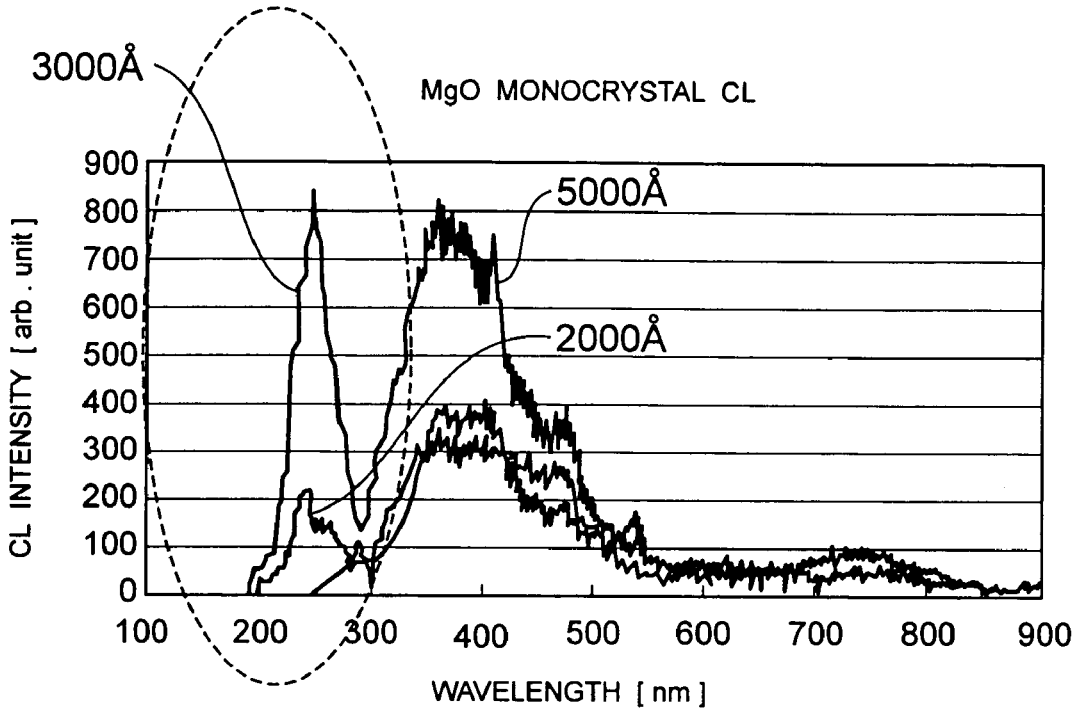
FIG. 10 is a graph showing a correspondence relation between a wavelength of CL light emission which is caused when an electron beam is radiated to a magnesium oxide monocrystal and CL light-emitting intensity.
Figure 11:
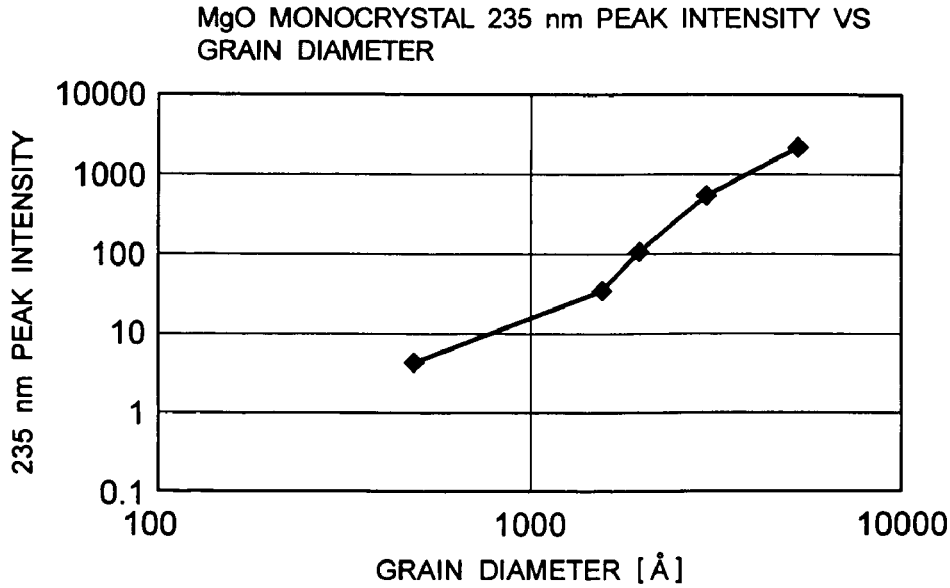
FIG. 11 is a graph showing a relation between a grain diameter of the magnesium oxide monocrystal and the CL light-emitting intensity at 235 nm.

In the PDP 50, therefore, by allowing the vapor phase magnesium oxide monocrystal whose shape is relatively large as shown in FIG. 5A or 5B to be included in the discharge space S of each display cell PC, a discharge probability in the discharge space S is raised. In the magnesium oxide monocrystal, since both of a CL light emission having a peak in a wavelength range of 300 to 400 nm as shown in FIG. 10 and a CL light emission having a peak in a wavelength range of 200 to 300 nm (particularly, near 235 nm in a range of 230 to 250 nm) are caused by the irradiation of an electron beam, it is considered that the magnesium oxide monocrystal has an energy level corresponding to 235 nm. In this instance, in the CL light emission having the peak at 235 nm, the larger a grain diameter of the vapor phase magnesium oxide monocrystal is, the larger its peak intensity is as shown in FIG. 11. That is, when the vapor phase magnesium oxide crystal is formed, if magnesium is heated at a temperature higher than the ordinary temperature, the relatively large monocrystal whose grain diameter is equal to 2000 Å or more as shown in FIG. 5A or 5B is formed together with the vapor phase magnesium oxide monocrystal whose average grain diameter is equal to 500 Å. In this process, since the temperature upon heating magnesium is higher than the ordinary temperature, a length of flame which is generated by reacting magnesium and oxygen also becomes long. Since a temperature difference between the flame and the ambience, therefore, increases, it is presumed that a larger amount of monocrystal of a high energy level corresponding to 200 to 300 nm (particularly, 235 nm) is contained in a group of vapor phase magnesium oxide monocrystal whose grain diameter is larger. The vapor phase magnesium oxide monocrystal has such a feature that purity is higher, particles are finer, a degree of aggregation of the particles is lower, and the like as compared with those of the magnesium oxide formed by another method.

It is, therefore, presumed that since the vapor phase magnesium oxide monocrystal has the high energy level corresponding to 235 nm as mentioned above, the electrons are captured for a long time (a few milliseconds) and the captured electrons are emitted by applying an electric field upon selective discharge, thereby promptly obtaining the initial electrons necessary for the discharge. If the vapor phase magnesium oxide monocrystal which performs the CL light emission having a peak in the range of 200 to 300 nm by the irradiation of the electron beam is contained in the magnesium oxide layer 13 as shown in FIG. 3, the electrons of an amount enough to cause the discharge exist always in the discharge space S. The discharge probability in the discharge space S rises remarkably.

Figure 12:
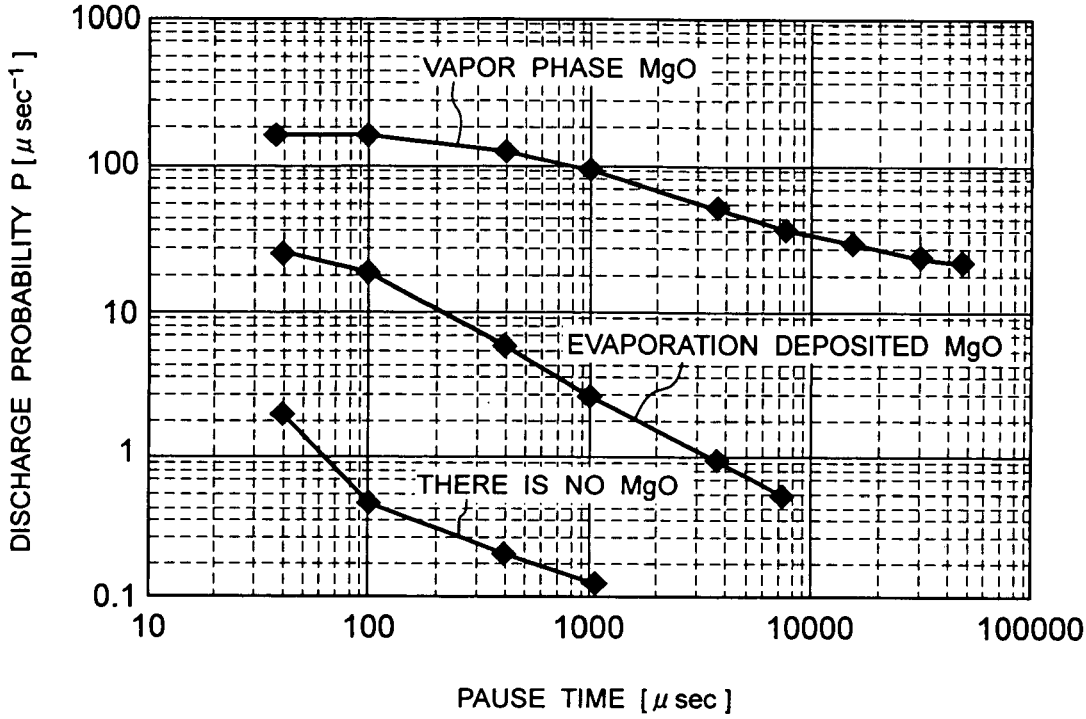
FIG. 12 is a diagram showing a discharge probability in the case where a magnesium oxide layer is not formed in a display cell PC, a discharge probability in the case where the magnesium oxide layer has been formed by a conventional evaporation depositing method, and a discharge probability in the case where the magnesium oxide layer containing a magnesium oxide monocrystal in which a CL light emission having a peak in a range of 200 to 300 nm is excited by irradiation of an electron beam.
Figure 13:
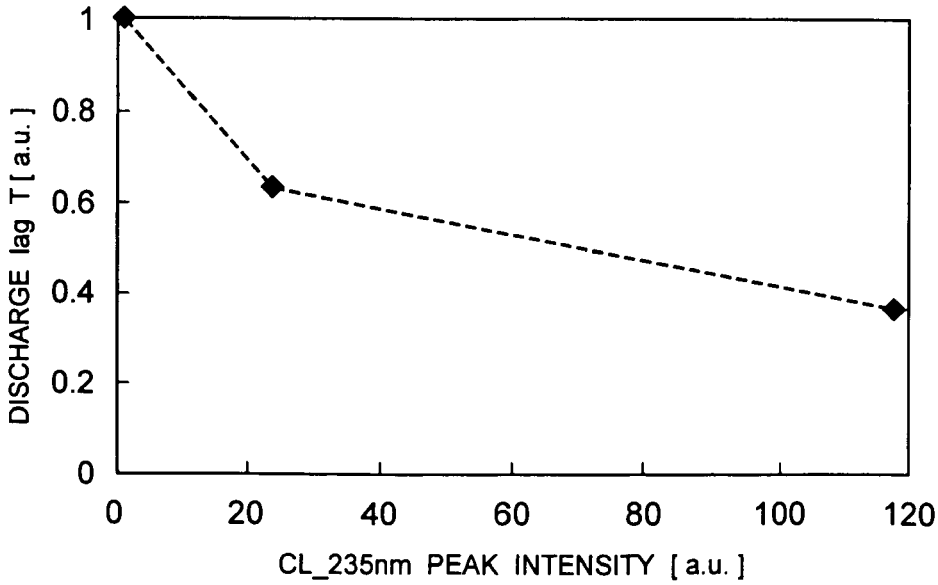
FIG. 13 is a diagram showing a correspondence relation between CL light-emitting intensity having a peak of 235 nm and a discharge delay time.

FIG. 12 is a diagram showing a discharge probability in the case where a magnesium oxide layer is not formed in the display cell PC, a discharge probability in the case where the magnesium oxide layer has been formed by the conventional evaporation depositing method, and a discharge probability in the case where the magnesium oxide layer containing the vapor phase magnesium oxide monocrystal which causes the CL light emission having the peak in the range of 200 to 300 nm by the irradiation of the electron beam has been formed, respectively. In FIG. 12, an axis of abscissa denotes a pause time of the discharge, that is, a time interval from the occurrence of the discharge to the occurrence of the next discharge. As mentioned above, if the magnesium oxide layer 13 containing the vapor phase magnesium oxide monocrystal which performs the CL light emission having the peak in the range of 200 to 300 nm by the irradiation of the electron beam is provided in each display cell PC, the discharge probability is raised more than that in the case where the magnesium oxide layer is formed by the conventional evaporation depositing method. As a magnesium oxide monocrystal, as shown in FIG. 13, the larger the intensity of the CL light emission when the electron beam is radiated, particularly, the CL light emission having the peak at 235 nm is, the more the discharge lag which is caused in the discharge space S can be shortened.

Even if the amount of priming particles remaining in the discharge space S is insufficient, therefore, the selective discharge can be certainly caused, so that the number of times of the sustaining discharge to be allocated to the subfield of the minimum luminance weight is set to only one, thereby enabling the luminance change in the image of low luminance to be gently expressed.

Further, since the discharge probability in the discharge space S rises, even if the peak voltage value of the first reset pulse $RP_{Y1}$ is increased in the resetting step R, the first resetting discharge of the weak discharge intensity can be stably caused. In this instance, since the T-shaped transparent electrodes Ya and Xa are used, the resetting discharge is locally caused near the discharge gap, so that such a sudden strong discharge that the discharge is caused to the whole row electrode is suppressed. The stable and very weak first resetting discharge is caused for a short time.

Although the $2^N$ gradation driving as shown in FIG. 9 is executed on the basis of the light emission driving sequence as shown in FIGS. 7 and 8 in the embodiment, (N+1) gradation driving as shown in FIG. 14 can also be executed.

In the (N+1) gradation driving shown in FIG. 14, the luminance level shown by the input video signal is expressed by (N+1) gradations by using the N subfields. In the (N+1) gradation driving, the sustaining discharge is certainly caused (shown by the white circles) in the subfield SF1 of the minimum luminance weight excluding the case of showing the black display (first gradation driving) and the sustaining discharge is continuously caused in the subfields of the number corresponding to the luminance level to be expressed (shown by the white circles).

Figure 15:
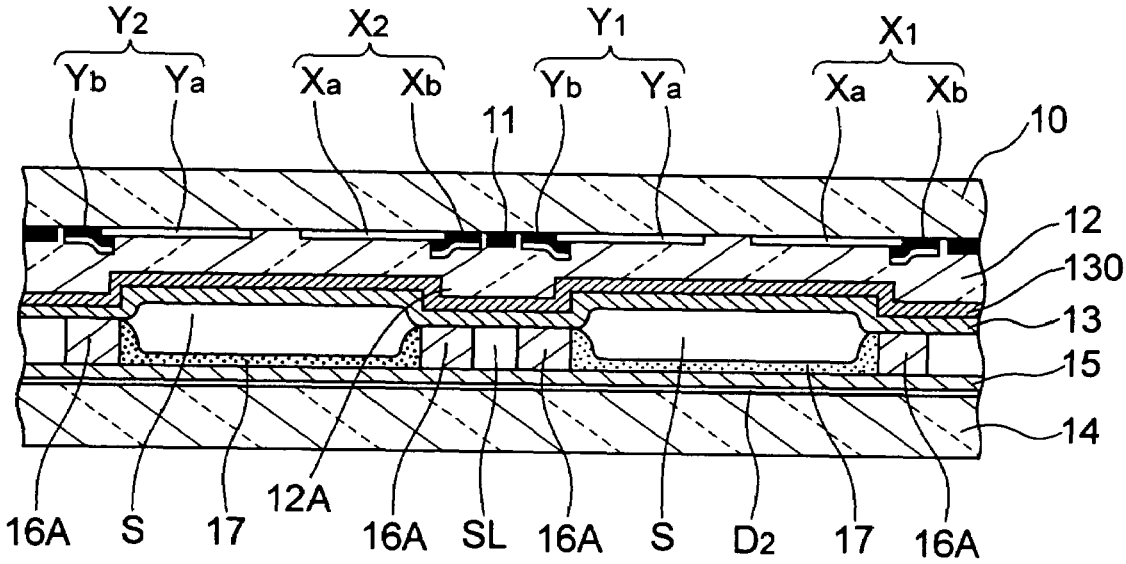
FIG. 15 is a graph showing another example of a cross section taken along the line V3-V3 shown in FIG. 2.
Figure 16:
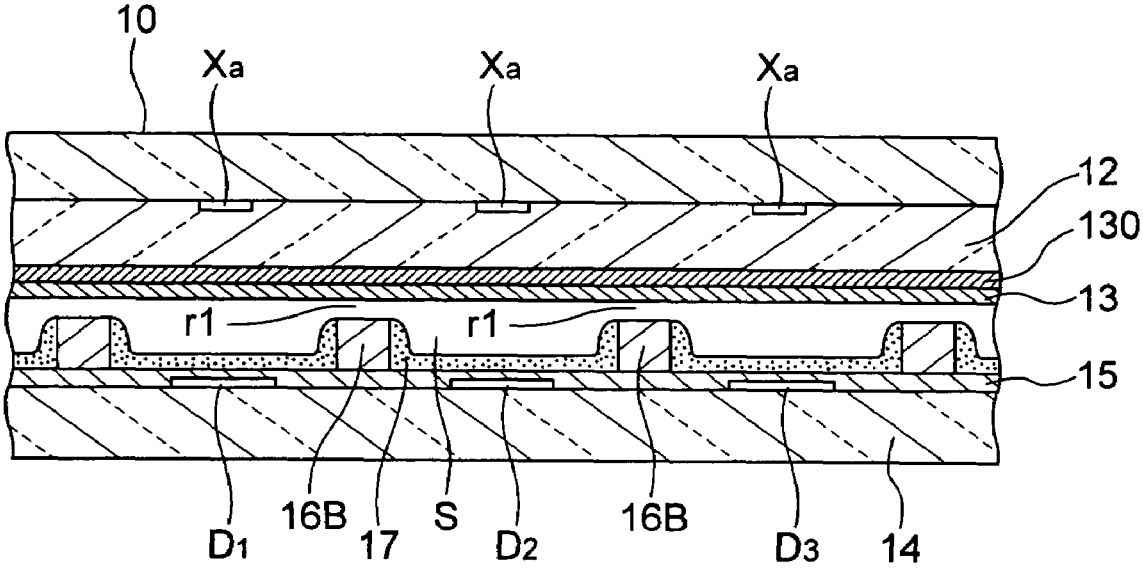
FIG. 16 is a graph showing another example of a cross section taken along the line W2-W2 shown in FIG. 2.

Although the magnesium oxide layer 13 containing the magnesium oxide monocrystal as shown in FIG. 5A or 5B is formed on the surface of the dielectric layer 12 in the embodiment, a thin film magnesium oxide layer 130 formed by the evaporation depositing method or sputtering can be also provided between them as shown in FIGS. 15 and 16.

The embodiment has been described with respect to the case where what is called a selective write addressing method whereby all of the display cells are initialized to the state where the predetermined amount of wall charges do not remain (resetting step R) and the predetermined amount of wall charges are selectively formed in each display cell on the basis of the input video signal (addressing step W) is used as a driving method of gradation-driving the PDP 50. As a driving method of gradation-driving the PDP 50, however, what is called a selective erasure addressing method whereby the predetermined amount of wall charges are formed in all of the display cells (resetting step R) and the predetermined amount of wall charges formed in each display cell are selectively erased in accordance with the pixel data (addressing step W) can be also used.

This application is based on Japanese Patent Applications Nos. 2004-137528, 2004-204158 and 2004-338259 which are hereby incorporated by reference.

What is claimed is:

1. A plasma display apparatus in which a plasma display panel on which a display cell having a discharge space is formed in each of crossing portions of a plurality of row electrode pairs and a plurality of column electrodes extending in the direction which crosses each of said row electrode pairs is driven for each of a plurality of subfields having different luminance weights, comprising:

a magnesium oxide layer containing magnesium oxide crystals which are formed in each of said display cells, and have a characteristic of performing a cathode luminescence light emission having a peak in a wavelength range of 200 to 300 nm when irradiated by an electron beam;

an addressing component for setting each of said display cells into a light-on cell state or a light-off cell state by selectively causing a selective discharge in said discharge space of each of said display cells by sequentially applying a scanning pulse to one row electrode of each of said row electrode pairs and applying a data pulse corresponding to an input video signal to each of said column electrodes; and a sustaining component for causing a sustaining discharge in said display cell which has been set into said light-on cell state by applying sustaining pulses to each of said row electrode pairs by the number of times corresponding to said luminance weight of each of said subfields, wherein said sustaining component applies said sustaining pulse to said row electrode pair only once in said subfield having the minimum luminance weight among said subfields.

2. An apparatus according to claim 1, wherein each of the row electrodes constructing said row electrode pair has a main body portion extending in the row direction and a projecting portion projecting in the column direction from said main body portion so as to face each other through a discharge gap.

3. An apparatus according to claim 2, wherein the projecting portion of said row electrode has a wide width portion near the discharge gap and a narrow width portion connecting said wide width portion to said main body portion.

4. An apparatus according to claim 1, wherein said magnesium oxide layer contains magnesium oxide monocrystals which are formed by vapor phase oxidizing a magnesium vapor which is generated by heating magnesium.

5. An apparatus according to claim 4, wherein said magnesium oxide layer contains magnesium oxide monocrystals whose grain diameter is equal to 2000 Å or more.

6. An apparatus according to claim 5, wherein said magnesium oxide monocrystal performs a cathode luminescence light emission having a peak in a wavelength range of 230 to 250 nanometers.

7. An apparatus according to claim 1, wherein said magnesium oxide layer is formed on a dielectric layer which covers said row electrode pair.

8. An apparatus according to claim 1, wherein in a unit display period in the input video signal, said subfields are arranged in order of said smaller luminance weight.

9. An apparatus according to claim 8, wherein said addressing component sets said display cell into said light-on cell state in said unit display period in each of the subfields which are continuous from the head subfield by the number corresponding to a luminance level shown by said input video signal.

10. An apparatus according to claim 1, wherein said addressing component sets said display cell into said light-on cell state in said unit display period in each of the subfields which are continuous from the head subfield by the number corresponding to a luminance level shown by said input video signal.

11. An apparatus according to claim 1, wherein said magnesium oxide layer serving as a protection layer is made of a magnesium oxide thin layer and magnesium oxide single crystals spread on said magnesium oxide thin layer, and wherein said magnesium oxide single crystals have a cathode luminescence light emission characteristic having a peak in a wavelength range of 200-300 nm.

12. An apparatus according to claim 1, wherein said magnesium oxide single crystals are exposed to said discharge space.

13. An apparatus according to claim 1, wherein said magnesium oxide single crystals are single crystals of cubic crystal structure.

14. An apparatus according to claim 1, wherein said magnesium oxide single crystals are oriented randomly.

15. A driving method of a plasma display panel which is driven every plural subfields having different luminance weights and on which a display cell having a magnesium oxide layer containing magnesium oxide crystals that have a characteristic of performing a cathode luminescence light emission having a peak in a wavelength range of 200 to 300 nm when excited by irradiation of an electron beam and a discharge space that faces said magnesium oxide layer is formed in each of crossing portions of a plurality of row electrode pairs and a plurality of column electrodes extending in the direction which crosses each of said row electrode pairs, comprising:

an addressing step of setting each of said display cells into a light-on cell state or a light-off cell state by selectively causing a selective discharge in said discharge space of each of said display cells by sequentially applying a scanning pulse to one row electrode of each of said row electrode pairs and applying a data pulse corresponding to an input video signal to each of said column electrodes; and a sustaining step of causing a sustaining discharge in said discharge space of said display cell which has been set into said light-on cell state by applying a sustaining pulse to each of said row electrode pairs wherein in said sustaining step, said sustaining pulse is applied to said row electrode pair only once in the subfield having the minimum luminance weight among said subfields.

16. A method according to claim 15, wherein each of the row electrodes constructing said row electrode pair has: a main body portion extending in the row direction; and a projecting portion projecting in the column direction from said main body portion so as to face each other through a discharge gap.

17. A method according to claim 16, wherein the projecting portion of said row electrode has a wide width portion near the discharge gap and a narrow width portion connecting said wide width portion to said main body portion.

18. A method according to claim 15, wherein said magnesium oxide layer contains magnesium oxide monocrystals which are formed by vapor phase oxidizing a magnesium vapor which is generated by heating magnesium.

19. A method according to claim 18, wherein said magnesium oxide layer contains magnesium oxide monocrystals whose grain diameter is equal to 2000 Å or more.

20. A method according to claim 15, wherein said magnesium oxide layer performs a cathode luminescence light emission having a peak in a wavelength range of 230 to 250 nanometers.

21. A method according to claim 15, wherein said magnesium oxide layer is formed on a dielectric layer which covers said row electrode pair.

22. A method according to claim 15, wherein in a unit display period in the input video signal, said subfields are arranged in order of said smaller luminance weight.

23. A method according to claim 15, wherein in said addressing step, said display cell is set into said light-on cell state in said unit display period in each of the subfields which are continuous from the head subfield by the number corresponding to a luminance level shown by said input video signal.

24. A method according to claim 22, wherein in said addressing step, said display cell is set into said light-on cell state in said unit display period in each of the subfields which are continuous from the head subfield by the number corresponding to a luminance level shown by said input video signal.

* * * * *